US006857934B2

(12) United States Patent
Chan

(10) Patent No.: US 6,857,934 B2
(45) Date of Patent: Feb. 22, 2005

(54) SAFETY BUBBLE CUSHION BRA-SHEATH

(75) Inventor: Kam Tong Chan, Kaiping (CN)

(73) Assignee: Kaiping City Chang Sha Four K Knitters Factory, Kaiping (CN)

( * ) Notice: Subject to any disclaimer, the term of this patent is extended or adjusted under 35 U.S.C. 154(b) by 0 days.

(21) Appl. No.: 10/616,645

(22) Filed: Jul. 10, 2003

(65) Prior Publication Data

US 2004/0014393 A1 Jan. 22, 2004

(30) Foreign Application Priority Data

Jul. 16, 2002 (CN) ..... 02134359 A
Jul. 16, 2002 (CN) ..... 02271753 U

(51) Int. Cl.[7] ..... A41C 3/00
(52) U.S. Cl. ..... 450/41; 2/255
(58) Field of Search ..... 450/41, 42, 45–51, 450/53; 2/255–260, 260.1, 261, 264, 73, 78.1–78.4

(56) References Cited

U.S. PATENT DOCUMENTS 3,685,549 A * 8/1972 Goff et al. ..... 139/24
5,669,247 A * 9/1997 McCartney et al. ..... 66/195
6,082,145 A * 7/2000 Lonati et al. ..... 66/176
6,682,395 B2 * 1/2004 Falla et al. ..... 450/41

* cited by examiner

*Primary Examiner*—Gloria M. Hale
(74) *Attorney, Agent, or Firm*—Alix, Yale & Ristas, LLP

(57) ABSTRACT

A bra sheath comprising a sheath-body and a plurality of lugs attached to the inner surface of an elongated liner. The sheath-body and liner define a tunnel for an underwire. A softness layer is disposed adjacent the liner outer surface. The bra sheath is formed by folding the liner and softness layer along the medial line to form a longitudinally extending internal cavity. The liner and sheath-body are comprised of woven fabrics including interlocking warp and weft threads. At least some of the threads are comprised of heat fusible materials that are melted during processing to bond the woven fabric of the liner and sheath-body.

19 Claims, 2 Drawing Sheets

SAFETY BUBBLE CUSHION BRA-SHEATH

This application claims the benefit of Chinese Patent Application No. 02134359.4, filed Jul. 16, 2002 and Chinese utility model application 02271753.6 filed Jul. 16, 2002.

FIELD OF THE INVENTION

The present invention relates to a kind of fabric. More particularly the present invention relates to a bra sheath used in woman's support apparel such as a brassiere, swimsuit and/or simple nightdress.

BACKGROUND OF THE INVENTION

In woman's brassieres it is the common practice to provide a tubular pocket or sheath, for example below a brassiere cup, in which a support wire, frequently referred to as an "underwire" is received to assist in maintaining the shape of the cup. The conventional bra sheath is comprised of fabric. The fabric is woven from weft and warp threads. Typically, the fabric is loosely woven and may easily be penetrated by the metal support wire in the bra sheath leading to injury of the user. The tendency of the support wire to pierce through the fabric of the bra sheath also complicates laundering of the brassiere. To avoid this problem conventional bra sheaths are comprised of multiple fabric layers, which not only consumes more fabric, but also makes the bra sheath harder and very uncomfortable to the wearer.

There have been attempts to improve the structure of brassieres. One such attempt is disclosed in Chinese patent of publication number CN 2332197 Y (Application Number: ZL 98 2 03044.4) entitled: Massage Bra By Human Natural Force and published on Aug. 11, 1999. This Chinese patent discloses a brassiere having a liquid bag in the inner surface of a bra-cup and a massage cloth containing unsmoothed type small lugs in the outer surface of the liquid bag. The liquid bag is filled with different proportions of liquids each having a different specific gravity. When the user moves the different liquids in the liquid bag collide, mix and separate to cause small vibrations. The Chinese patent claims that the disclosed construction can produce a beneficial vibration massage effect for the user compared to an ordinary brassiere. However, the above structure increases brassiere weight and if the brassiere with this structure is used with steel support wires there may be the danger of liquid leakage from the steel wire end head piercing the liquid bag.

Chinese patent of publication number CN 2240871 Y (Application Number: ZL 95 2 12886.1) entitled Supported Health Bra and published on Nov. 27, 1996 discloses a health bra improving bra sheath strip. This disclosure illustrates placing a protruding platform on the lined brassiere sheath strip in the arc of under part of existing bra and in inner side keeping in touch with the chest. The Chinese patent claims that this arrangement provides a healthy massage to guarantee that lymph liquid circulates normally. However the brassiere sheath strip is still a loosely woven textile layer that is easily pierced by the support wire, resulting in injuring the user, so it is not ideal to use yet. There remains a need for a bra sheath that will lessen or eliminate the problem of the metal support wire piercing the loose textile layer of a brassiere sheath.

SUMMARY OF THE INVENTION

An object of the invention is to offer a simple and comfortable, safe and reliable bra sheath that is more resistant to piercing by a support wire.

Briefly, in one advantageous embodiment, a safety bra sheath comprises a woven fabric liner having an inner surface, an outer surface, opposing edges and a longitudinally extending medial line. An elongated fabric sheath body having opposing edges is attached to the liner so that one sheath body edge is adjacent one liner edge and the opposing sheath body edge is disposed toward the opposing liner edge. The sheath body edges are attached to the liner. The material of the sheath body intermediate the attached edges is free of the liner so that a tunnel for an underwire is formed. A plurality of lugs or beads is attached to, and projects from, the liner inner surface. A softness layer is disposed adjacent the liner outer surface.

The bra sheath is formed by folding the liner and the softness layer along the medial line so that the liner edges meet and are attached. The liner inner surface of the formed bra sheath defines an internal cavity. The wire tunnel and lugs project from opposing sides of the inner cavity. Advantageously, the lugs oppose the wire tunnel within the internal cavity. In some preferred embodiments, the internal cavity substantially extends the length of the bra sheath.

In this embodiment the liner and sheath-body are each a single layer, closely woven fabric comprised of interlocked warp threads and weft threads. At least some of the fabric threads comprise a heat fusible thermoplastic material. Other materials of the fabric threads are selected from elastic nylon, nylon, elastic urethane, urethane and combinations thereof. The materials can be alternated during weaving, for example alternating heat fusible threads and elastic nylon threads and alternating nylon and elastic urethane threads. The fabric is heated after weaving to melt the heat fusible threads and bond the fabric.

The open structure of the formed bra sheath with the internal cavity increases the thickness of the formed bra sheath, provides a cushioning, gasbag type protection layer and improves the resistance of the bra sheath to penetration by the support wire. The inventive bra sheath is simple in structure, easy to manufacture, more comfortable to the user and saves raw materials and weight compared to a conventional bra sheath having multiple layers of fabric in a solid cross section. The bonded fabric of the liner and sheath-body is more resistant to penetration by an underwire, the formed bra sheath as a whole retains flexibility and the softness layer increases comfort to a user.

In general, the invention may be alternately formulated to comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

BRIEF DESCRIPTION OF THE DRAWINGS

Other objects and advantages of the invention will be evident to one of ordinary skill in the art from the following detailed description made with reference to the accompanying drawings, in which.

DETAILED DESCRIPTION OF THE INVENTION

Figure 1:
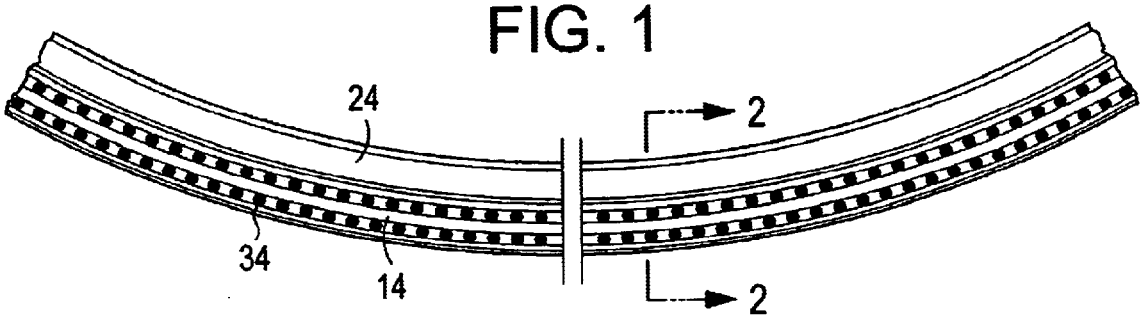
FIG. 1 is an illustration of an unfolded bra sheath.
Figure 2:
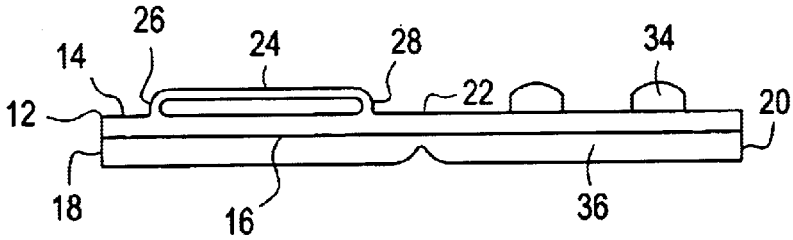
FIG. 2 is an enlarged sectional view taken along the lines of 2—2 of FIG. 1
Figure 3:
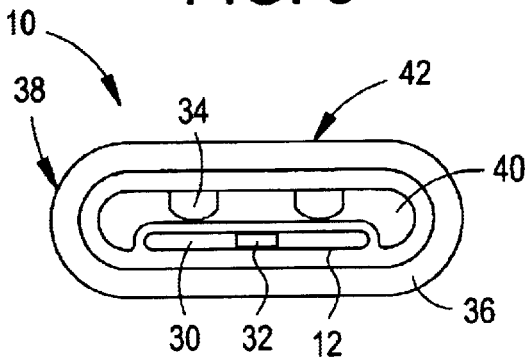
FIG. 3 is a cross sectional view of the formed bra sheath.

One aspect of the invention is an elongated bra sheath 10 (shown best in FIG. 3), comprising an elongated fabric liner 12 having an inner surface 14, an outer surface 16, opposing edges 18, 20 and a longitudinally extending medial line 22. An elongated fabric sheath body 24 having opposing edges 26, 28 is attached to the liner so that one sheath body edge 26 is adjacent one liner edge 18 and the opposing sheath body edge 28 is disposed toward the opposing liner edge 20. The edges 26, 28 of the sheath body 24 are attached to the liner 12 by, for example, weaving, stitching, heat bonding or adhesive bonding. The material of the sheath body 24 intermediate the attached edges 26, 28 is free of the liner so that a tunnel 30 for an underwire is formed. Advantageously, the sheath body is attached to one side of the medial line 22 as shown in FIG. 2. In some preferred embodiments, the sheath body substantially extends the length of the liner 12. A plurality of lugs or beads, each 34, is attached to, and projects from, the liner inner surface 14. Advantageously, the lugs 34 are disposed in two, longitudinally extending rows opposite of the medial line 22 from the sheath body 24. The lugs are formed from a plurality of longitudinally extending stretch nylon yarns. The nylon yarns forming the lugs 34 are interleaved at spaced positions 38 with threads in the liner 12 using a needle loom. The interleaved yarns and threads attach the lugs 34 to the liner 12. In one advantageous embodiment the lugs 34 intermediate the spaced positions 38 are adjacent, but not attached to, the liner inner surface 14. A softness layer 36 is disposed adjacent the liner outer surface 16.

The bra sheath 10 is formed by folding liner 12 and softness layer 36 along the medial line 22 so that the liner edges 18, 20 meet. The liner inner surface 14 of the formed bra sheath 10 defines an internal cavity 40. The wire tunnel 30 and lugs 34 project from opposing sides of the inner cavity 40. Advantageously, the lugs 34 oppose the wire tunnel 30 within the internal cavity 40. In some preferred embodiments, the internal cavity 40 substantially extends the length of the bra sheath 10.

Stitching 38 joins the liner edges 18, 20 and attaches the formed bra sheath 10 to the apparel. It may also be possible to use two lines stitching (not illustrated), one line adjacent edges 18, 20 and the other line adjacent the medial line 22, to form the bra sheath and attach it to the apparel. In the joined condition, surface 42 of the softness layer 36 will be adjacent the wearer. The underwire 32 will be separated from the wearer by the softness layer 36, the liner 12, the lugs 34, the internal cavity 40 and the sheath body 24.

The open structure of the formed bra sheath 10 with the opposing lugs 34 and wire tunnel 30 within the internal cavity 40 increases the thickness of the formed bra sheath 10, provides a cushioning, gasbag type protection layer and improves the resistance of the bra sheath to penetration by the support wire. The inventive bra sheath 10 is simple in structure, easy to manufacture, more comfortable to the user and saves raw materials and weight compared to a conventional bra sheath having multiple layers of fabric in a solid cross section.

Figure 4:
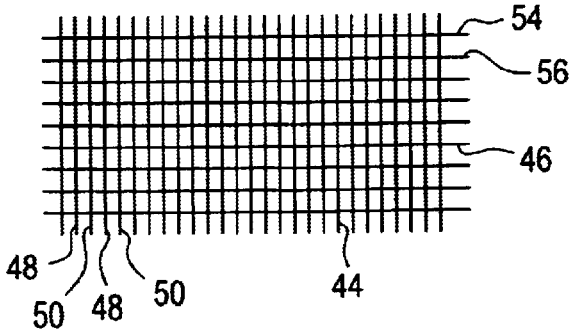
FIG. 4 is an illustration of the woven components of the inventive bra sheath.
Figure 5:
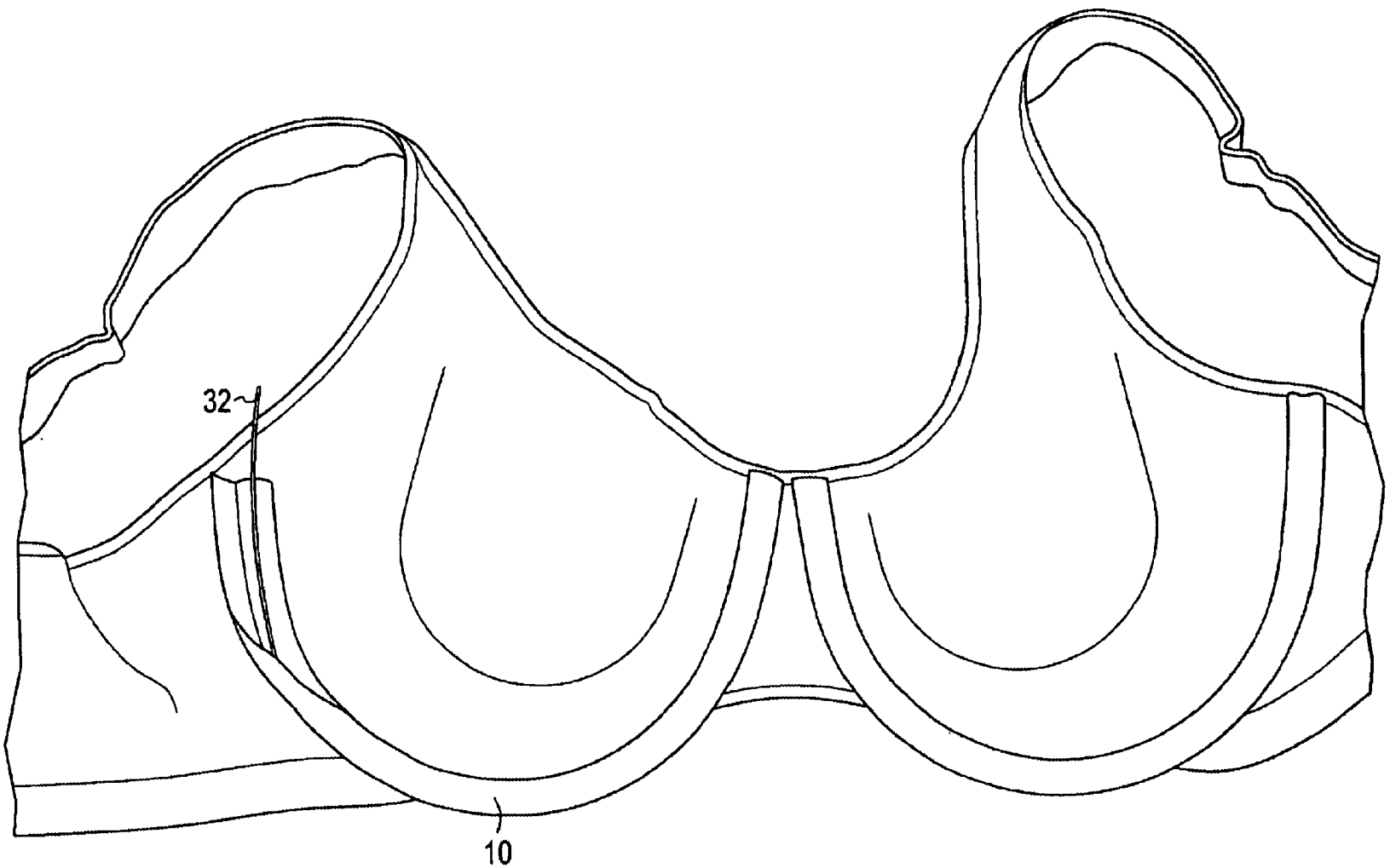
FIG. 5 is an illustration of part of a a bra incorporating the inventive bra sheath.

Advantageously, the liner 12 and sheath-body 24 are each a single layer, woven fabric comprised of interlocked warp threads 44 and weft threads 46 as shown in FIG. 4. Advantageously at least one of the warp threads 44 or weft threads 46 is a heat fusible thread 48 comprised of a thermoplastic polymer. Nylon having a melting point range of about 85° C. to about 100° C. has been found suitable for use as a heat fusible thread. The woven fabric is heated to melt the heat fusible thread 48 and bond the woven warp and weft threads within the fabric.

Advantageously, the warp threads 44 comprising the fabric used for the liner 12 and sheath-body 24 can comprise heat fusible thread 48 and elastic nylon thread 50, interlocked with weft threads 46. As one example, advantageous for making the invention stick firm and reliable and easy to manufacture, the warp threads 44 in the fabric of the liner 12 and sheath-body 24 are comprised of alternating heat fusible threads 48 and elastic nylon lines 50. The weft threads 46 in the liner 12 and sheath-body 24 can be selected from nylon thread, elastic urethane thread and combinations thereof. Advantageously the softness layer 36 is formed by the warp and weft nylon threads.

Alternatively, the weft threads 46 comprising the fabric used for the liner 12 and sheath-body 24 can comprise heat fusible thread 54 and elastic nylon thread 56, interlocked with warp threads 44. As one advantageous example the weft threads 46 in the liner 12 and sheath-body 24 are comprised of alternating heat fusible threads 54 and elastic nylon lines 56. The warp threads 44 in the liner 12 and sheath-body 24 can be selected from nylon thread, elastic urethane thread and combinations thereof. Advantageously the softness layer 36 is formed by of the warp and weft threads.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A bra sheath, which comprises a sheath-body that can hold an underwire, characterized by the fact that the sheath-body is attached to an inner surface of a liner, and including at least one row of lugs in the inner surface of the liner in a position corresponding to the underwire in the sheath-body.

2. A bra sheath according to claim 1, wherein there are two rows of lugs in the inner surface of the liner, and a gap between the two rows of lugs.

3. A bra sheath according to claim 1, wherein said sheath-body and liner are woven from a plurality of warp threads and a plurality of weft threads interlocked as a whole, and there is at least one piece of heat fusible thread among at least one of the warp threads and the weft threads, and wherein the warp threads and the weft threads are bonded to form the inner surface of the sheath-body and the surface of the liner separately after melting the heat fusible thread.

4. A bra sheath according to claim 3, wherein said sheath-body is woven from synthetic warp threads, which warp threads are comprised alternately of a heat fusible thread and an elastic nylon thread, each interlocked with the weft threads.

5. A bra sheath as recited in claim 4 characterized by the fact that the warp threads are comprised of two pieces of elastic nylon thread and two pieces of heat fusible thread in alternating order.

6. A bra sheath according to claim 5, wherein said weft threads are comprised of nylon thread, urethane elastic thread, or combinations thereof, and the weft threads forms a softness layer on the outer surface of the liner.

7. A bra sheath according to claim 3, wherein said sheath-body and the liner are woven from synthetic weft threads, which weft threads are comprised of a heat fusible thread and an elastic nylon thread in alternating order, each interlocked with the warp threads.

8. A bra sheath according to claim 7, wherein said weft threads are comprised of two pieces elastic nylon thread and two pieces of heat fusible thread in alternating order.

9. A bra sheath according to claim 8, wherein said warp threads are comprised of nylon thread, urethane elastic thread or combinations thereof, and the warp threads forms a softness layer on the outer surface of the liner.

10. A bra sheath comprising:

an elongated liner folded along a medial line and having an inner surface;

a sheath-body having opposing edges attached to the liner inner surface to define a tunnel between the liner inner surface and the sheath-body;

a plurality of lugs attached to the liner inner surface; and a softness layer disposed adjacent an outer surface of the folded liner.

11. The bra sheath of claim 10 wherein the lugs and the tunnel project from opposing sides of the liner inner surface in a face to face relationship.

12. The bra sheath of claim 10 further comprising an underwire in the tunnel.

13. The bra sheath of claim 10 consisting of a flattened tubular structure defining an internal cavity therein.

14. The bra sheath of claim 10 wherein the liner is a fabric closely woven from interlocked threads.

15. The bra sheath of claim 10 wherein at least one of the liner and sheath-body is a fabric woven from interlocking threads comprising a heat fusible thermoplastic material.

16. The bra sheath of claim 10 wherein at least one of the liner and the sheath-body is a fabric woven from threads comprising a heat fusible thermoplastic material interlocked with threads selected from nylon, urethane and combinations thereof.

17. The bra sheath of claim 10 wherein at least one of the liner and the sheath-body is a fabric woven from threads comprising a heat fusible thermoplastic material interlocked with threads selected from nylon, urethane and combinations thereof and subjected to heat after weaving to melt the heat fusible threads and bond the fabric.

18. The bra sheath of claim 10 wherein the liner is a fabric woven from threads selected from nylon, urethane and combinations thereof, wherein the liner threads form the softness layer.

19. A brassiere comprising:

a bust cup;

a bra sheath comprising:

an elongated liner folded along a medial line and having an inner surface;

a sheath-body having opposing edges attached to the liner inner surface to define a tunnel between the liner inner surface and the sheath-body, wherein at least one of the liner and the sheath-body is a fabric closely woven from threads comprising a heat fusible thermoplastic material interlocked with threads selected from nylon, urethane and combinations thereof and subjected to heat after weaving to melt the heat fusible threads and bond the fabric;

a plurality of lugs attached to the liner inner surface; and a softness layer formed by the woven threads of the liner and disposed adjacent an outer surface of the folded liner, the softness layer being secured along a lower portion of the bust cup; and an underwire disposed in the tunnel.

* * * * *